United States Patent [19]

Braverman

[11] Patent Number: 4,984,327

[45] Date of Patent: Jan. 15, 1991

[54] SHOE HOLDER

[76] Inventor: George J. Braverman, 12950 Oxnard St., Van Nuys, Calif. 91401

[21] Appl. No.: 397,901

[22] Filed: Aug. 24, 1989

[51] Int. Cl.[5] ..... A47L 23/18

[52] U.S. Cl. ..... 15/267; 12/53.7; 12/115.6; 12/123; 211/35

[58] Field of Search ..... 15/267; 12/123, 124, 12/53.7, 115.6; 280/11.31; 211/35

[56] References Cited

U.S. PATENT DOCUMENTS

| | | | |
|---|---|---|---|
| 254,423 | 2/1882 | Yokom | 211/35 |
| 260,102 | 6/1882 | Langenbach | 211/35 |
| 436,974 | 9/1890 | Fiske | 12/124 |
| 641,928 | 1/1900 | Bowie | 15/267 |
| 675,274 | 5/1901 | Gardner | 15/267 |
| 751,036 | 2/1904 | Wichman | 211/35 |
| 1,567,037 | 12/1925 | Cavanna | 211/35 |
| 2,213,838 | 9/1940 | Glydenvand | 211/35 |
| 3,641,617 | 2/1972 | Lopez | 15/267 |
| 4,109,335 | 8/1978 | Randolph | 15/267 |

FOREIGN PATENT DOCUMENTS

| | | | |
|---|---|---|---|
| 525228 | 1/1954 | Belgium | 15/267 |
| 1172282 | 11/1969 | United Kingdom | 15/267 |

*Primary Examiner*—Timothy F. Simone
*Assistant Examiner*—Mark Spisich
*Attorney, Agent, or Firm*—Max Geldin

[57] ABSTRACT

A shoe holder particularly adapted for use in dyeing, cleaning or polishing shoes without touching the shoe, comprises a generally U-shaped flexible handle having a forward arcuate portion and a rear arcuate portion. A forwardly extending toe end is connected to the lower end of the forward arcuate portion for insertion into the toe of a shoe, and has a bent and rearwardly extending portion connected thereto. A tongue is also connected to the toe end and extends forwardly, both the tongue and bent rearwardly extending portions making contact with the inside of a shoe. The rear arcuate portion of the handle has connected to its lower end a heel end for insertion into the heel of a shoe, and terminating in an angled forwardly extending portion, for greater rigidity. The holder is in the form of an essentially unitary structure. The handle is constructed of a flexible, preferably plastic material so that when flexed, the toe and heel ends of the holder can be inserted into a shoe to securely position the shoe thereon, and the springiness of the flexible body portion maintains a shoe in fixed position on the holder while the holder is held by the hand to support the shoe, e.g. during dyeing thereof.

5 Claims, 1 Drawing Sheet

FIG. 1
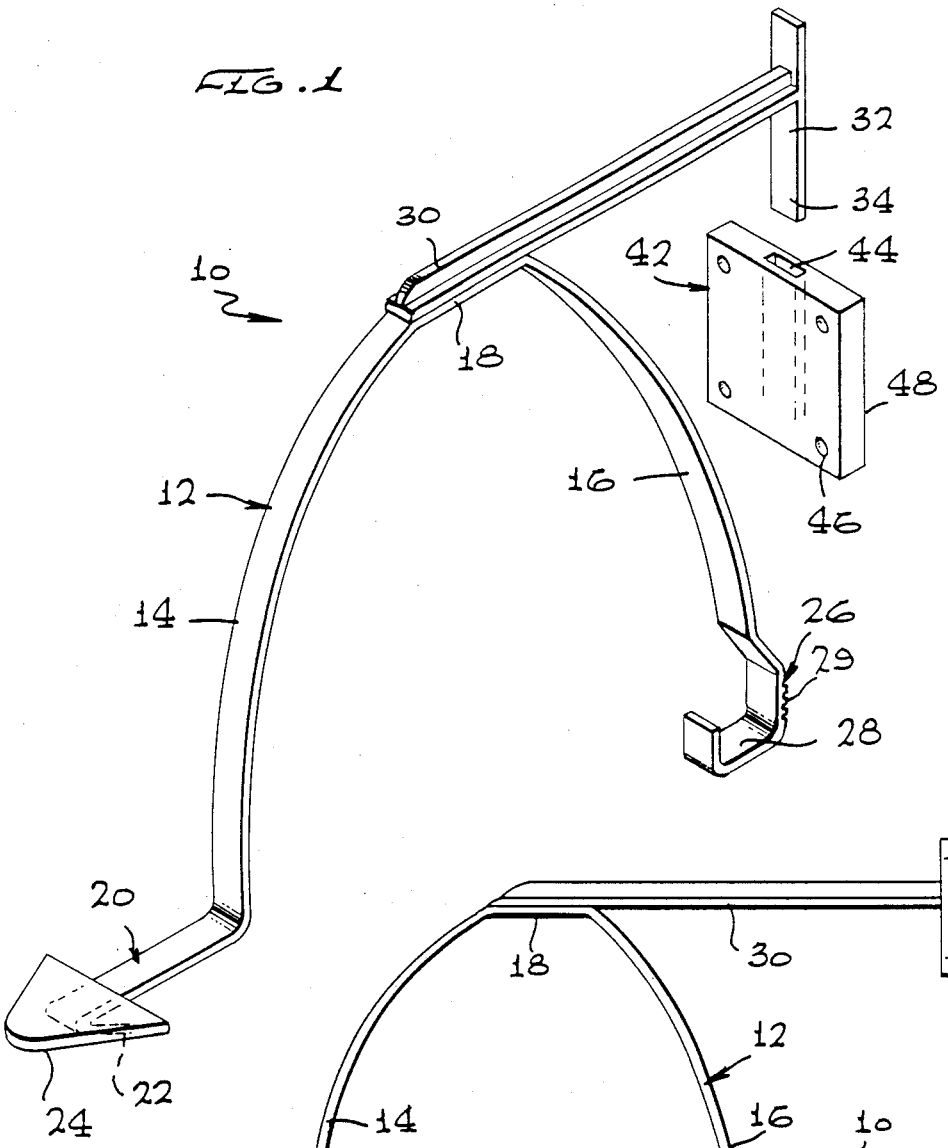
FIG. 3
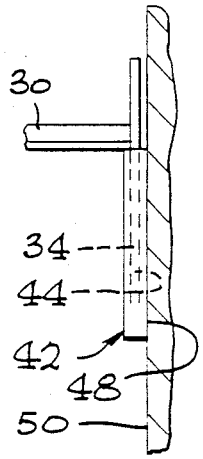
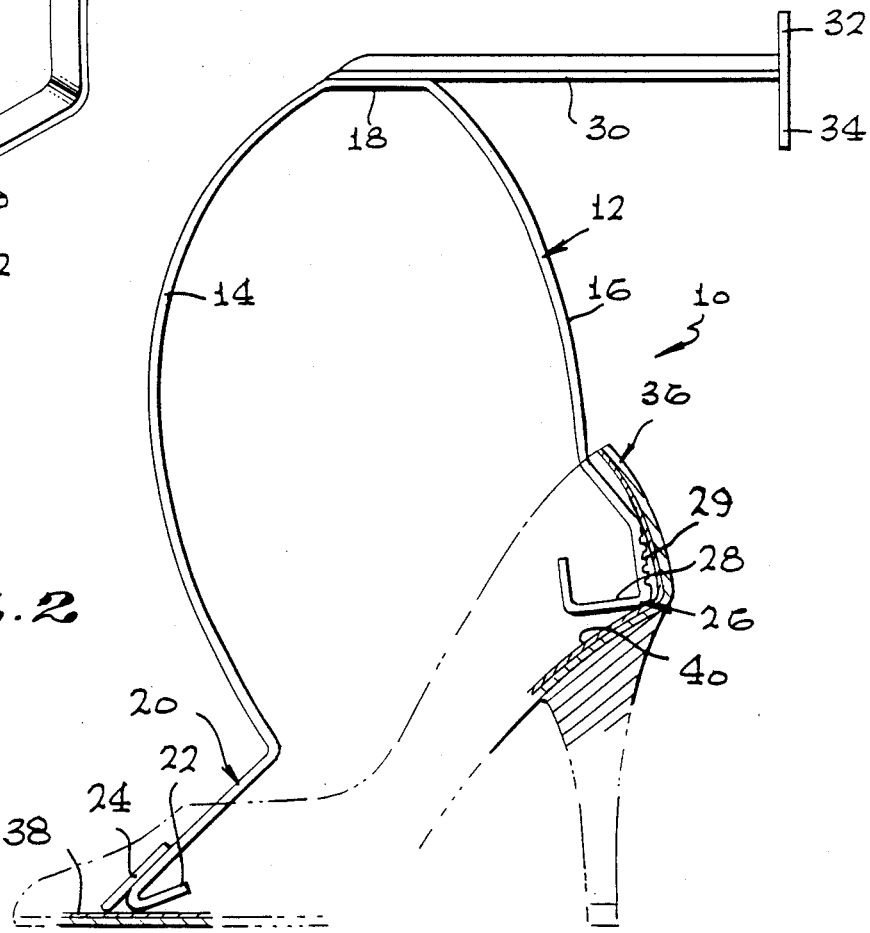
FIG. 2

SHOE HOLDER

BACKGROUND OF THE INVENTION

This invention relates to an improved shoe holder particularly adapted for use in dyeing, tinting, polishing and cleaning shoes, without the necessity for touching the shoe during any of these operations.

Various forms of shoe holders are of course well known in the art. Examples of prior art shoe holders are shown for example in U.S. Pat. Nos. 2,187,663; 2,575,408; 2,580,525; 3,123,850 and 4,483,039. However, many of these shoe holders are of relatively complex structure and hence are expensive, and many of these devices cannot be readily used and manipulated, for example, for dyeing shoes, without the necessity for the operator to touch the shoes during such operation, resulting in an unsatisfactory and messy procedure.

It is accordingly an object of the present invention to provide a holder for shoes which is simple and inexpensive to produce.

Another object is to provide a simple easily operated shoe holder particularly adapted for dyeing shoes, without the necessity of the operator touching the shoes during such operation.

A still further object is to provide a flexible essentially one piece shoe holder which can be readily inserted into a shoe for holding same in one hand during a dyeing, tinting, cleaning or polishing operation.

SUMMARY OF THE INVENTION

The above objects are achieved according to the invention by a simply constructed shoe holder formed of a generally U-shaped flexible handle having a forwardly bent portion and a rearwardly bent portion, a forwardly extending toe end connected to the lower end of the forwardly bent portion, for insertion into the toe of a shoe, and a heel end connected to the lower end of the rearwardly bent portion, for insertion into the heel of a shoe. In preferred practice, the U-shaped handle has a forward arcuate portion and a rear arcuate portion. The U-shaped flexible handle and the associated toe and heel ends form a one-piece unitary holder.

The toe end has a bent back and rearwardly extending portion and the heel end has an angled forwardly extending portion. A tongue is connected to the toe end of the device and extends forwardly to contact the inner sides of a shoe.

The holder is formed of a flexible material, for example a flexible plastic, and is essentially in the form of a single or integral one piece structure.

In use, for example, the toe end of the holder is inserted into the toe of a shoe such as a lady's pump, and the U-shaped handle is squeezed or flexed with the hand so as to place the rear portion in the heel of the shoe. The tongue and the bent back rearwardly extending portion on the toe portion hold the forward end of the holder in position in the shoe, and the heel end and the angled forwardly extending portion connected thereto are placed in position in the rear and heel of the shoe, with the back edge of the heel end abutting the back of the shoe and the angled forwardly extending portion maintaining the heel end of the holder in position on the shoe.

The springiness of the flexible holder body maintains the holder on the shoe while the holder is held by the hand to support the shoe, for example during dyeing thereof. Due to the flexibility of the U-shaped handle, the holder of the invention can be employed to support shoes of varying sizes.

An extension is connected to the arcuate portions or handle of the holder for mounting at its outer end on a support bracket on a wall, e.g. for drying the shoe following dyeing thereof.

BRIEF DESCRIPTION OF THE DRAWINGS

FIG. 1 is a prospective view of a shoe holder according to the invention;

FIG. 2 is a side view of the holder of FIG. 1, shown in operative position within a shoe; and FIG. 3 is a sectional view of a wall support bracket for mounting the shoe holder of the invention.

DETAILED DESCRIPTION OF A PREFERRED EMBODIMENT OF INVENTION

Referring to FIGS. 1 and 2 of the drawing, numeral 10 indicates a shoe holder according to the invention, which comprises a handle or body portion 12 having a forward arcuate portion 14 and a rear arcuate portion 16. Intermediate arcuate portions 14 and 16 is a straight portion 18.

A forwardly extending toe end 20 is connected to the lower end of the forward arcuate portion 14, and the toe end terminates in a bent back and rearwardly extending portion 22. A tongue 24 is connected to the outer portion of the toe end 20.

The rear arcuate portion 16 of the holder has an outwardly bent heel end 26 which terminates in an angled forwardly extending portion 28. The lower end of the heel end 26 has a plurality of grooves 29 on the outer surface thereof.

The holder is provided with an extension 30 which is connected at one end to the straight portion 18 of the handle and terminates at its outer end in a bracket 32 having a depending portion 34.

The basic elements of the shoe holder 10, namely elements 14, 16, 18, 20, 22, 26 and 28 form a one-piece integral or unitary holder which can be formed of any flexible or resilient material, e.g. a suitable plastic such as ABS (acrylonitrile-butadiene-styrene) plastic.

In practice, for insertion of the shoe holder 10 of the invention in a shoe such as a lady's pump indicated at 36 in FIG. 2, the toe end 20 and tongue 24 of the shoe holder is inserted into the toe of the shoe with the tongue 24 making contact with the inner front sides of the shoe, and the tongue and bottom of the angled portion 22 in contact with the inside of the sole portion 38 of the shoe, to maintain the front of the shoe in fixed position on the toe end of the holder.

The U-shaped arcuate portions 12 and 14 of the handle are flexed and squeezed together, and the heel end 26 of the holder is inserted into the heel of the shoe to the bottom of the shoe, with the grooves 29 maintaining the heel end 26 in frictional non-slipping engagement with the rear inner surface of the rear portion of the shoe, and the angled portion 28 providing for greater rigidity to maintain the rear portion of the shoe in fixed position on the holder.

The spring bias provided by the flexible body portion 12 of the handle maintains the holder in position on the shoe at both ends thereof, so that the shoe is securely supported on the holder while the holder is held by the hand of the operator, e.g. during dyeing thereof, or other procedures such as cleaning or polishing the shoe.

After dyeing or polishing the shoe, the shoe holder then can be mounted for support by inserting the lower portion 34 of the bracket into a hole 44 of a support bracket 42 mounted by fasteners in fastener holes 46 on the rear surface 48 of a wall 50.

Although the handle of the shoe holder if FIGS. 1 and 2 is preferably formed of arcuate portions 14 and 16, the U-shaped handle can be formed alternatively of angled portions or members.

From the foregoing, it is seen that the invention provides a simple, essentially one piece readily operable shoe holder for use in holding shoes for dyeing, tinting, cleaning or polishing the shoe, and can be manipulated with one hand during such operation and without touching the shoe during the particular procedure. The shoe holder of the invention can also be used for storing or hanging shoes in a closet, e.g. for drying after being worn in the rain, to maintain their shape.

Since various modifications of the invention device will occur to those skilled in the art, within the spirit of the invention, the invention is not to be taken as limited except by the scope of the appended claims.

What is claimed is:

1. A shoe holder particularly adapted for use in dyeing, cleaning or polishing shoes without touching the shoe, which comprises a generally U-shaped flexible handle having a forwardly bent portion and a rearwardly bent portion, and wherein said forwardly bent portion is a forward arcuate portion and said rearwardly bent portion is a rear arcuate portion, a forwardly extending toe end connected to the lower end of said forwardly bent portion, for insertion into the toe of a shoe, a heel end connected to the lower end of said rearwardly bent portion, for insertion into the heel of a shoe, a bent back and rearwardly extending portion connected to said toe end, for contact with the inside of the sole portion of a shoe, and an angled forwardly extending portion connected to said heel end, to provide greater rigidity, said U-shaped flexible handle and said associated toe end and heel end and said bent back and forwardly extending portions forming a one-piece unitary holder, whereby when said handle is flexed and said toe end and said heel end are inserted in proper position in a shoe to lock the holder onto the shoe, the handle is adapted to be grasped by one hand to hold the shoe without touching same.

2. The shoe holder of claim 1, wherein said forward and rear arcuate portions forming said handle, said toe end and bent back portion thereof, and said heel end and angled portion thereof, are formed integral from a flexible plastic.

3. A shoe holder particularly adapted for use in dyeing, cleaning or polishing shoes without touching the shoe, which comprises a generally U-shaped flexible handle having a forward arcuate portion and a rear arcuate portion, a forwardly extending toe portion connected to the lower end of said forward arcuate portion, for insertion into the toe of a shoe, said forwardly extending toe portion terminating in a bent and rearwardly extending portion, a tongue connected to the lower end of said forwardly extending toe portion adjacent to said bent portion, a rearwardly extending heel portion connected to the lower end of said rear arcuate portion, for insertion into the heel of a shoe, said rearwardly extending portion being grooved along the rear outer surface thereof for frictional engagement with the insole surface of the back of the shoe, and an angled forwardly extending portion connected to the lower end of said rearwardly extending heel portion, whereby when said handle is flexed and said forwardly extending toe portion and said rearwardly extending heel portion are inserted in proper position in a shoe, the shoe is fixedly positioned on the holder, with the tongue and bent rearwardly extending portion making contact with the inside of the shoe and the angled forwardly extending portion providing rigidity.

4. The shoe holder of claim 3, said handle including a straight portion at the upper end thereof and intermediate the forward and rear arcuate portions, and including an extension connected to said straight portion and a bracket mounted on one end of said extension for mounting said shoe holder and an associated shoe on a wall bracket support.

5. The shoe holder of claim 3, said arcuate portions of said handle, said straight portion thereof, said forwardly extending toe portion and bent rearwardly extending portion thereof, and said rearwardly extending heel portion and said angled forwardly extending portion thereof being integral and in the form of a flexible plastic.

* * * * *